US007894622B2

(12) United States Patent
Chen et al.

(10) Patent No.: US 7,894,622 B2
(45) **Date of Patent: *Feb. 22, 2011**

(54) MICROPHONE

(75) Inventors: Chun-Nan Chen, Tainan Hsien (TW); I-Ming Lin, Taichung (TW)

(73) Assignee: Merry Electronics Co., Ltd., Taichung (TW)

( * ) Notice: Subject to any disclaimer, the term of this patent is extended or adjusted under 35 U.S.C. 154(b) by 1165 days.

This patent is subject to a terminal disclaimer.

(21) Appl. No.: 11/549,336

(22) Filed: Oct. 13, 2006

(65) Prior Publication Data

US 2008/0090624 A1 Apr. 17, 2008

(51) Int. Cl.
*H04R 25/00* (2006.01)

(52) U.S. Cl. ..... 381/361; 381/355

(58) Field of Classification Search ..... 381/355, 381/358, 360, 361, 368
See application file for complete search history.

(56) References Cited

U.S. PATENT DOCUMENTS

| | | | | |
|---|---|---|---|---|
| 3,838,684 | A | 10/1974 | Manuel et al. | 128/2.05 P |
| 4,533,795 | A | 8/1985 | Baumhauer, Jr. et al. | 179/111 E |
| 4,598,585 | A | 7/1986 | Boxenhorn | 73/505 |
| 4,628,740 | A | 12/1986 | Ueda et al. | 73/705 |
| 4,776,019 | A | 10/1988 | Miyatake | 381/174 |
| 4,825,335 | A | 4/1989 | Wilner | 361/283 |
| 4,908,805 | A | 3/1990 | Sprenkels et al. | 367/181 |
| 4,910,840 | A | 3/1990 | Sprenkels et al. | 29/25.41 |
| 4,922,471 | A | 5/1990 | Kuehnel | 367/181 |
| 5,146,435 | A | 9/1992 | Bernstein | 367/181 |
| 5,151,763 | A | 9/1992 | Marek et al. | 357/26 |
| 5,178,015 | A | 1/1993 | Loeppert et al. | 73/718 |
| 5,272,758 | A | 12/1993 | Isogami et al. | 381/191 |

(Continued)

FOREIGN PATENT DOCUMENTS

| | | |
|---|---|---|
| EP | 0077615 | 4/1983 |

(Continued)

OTHER PUBLICATIONS

Hijab, R. S. and Muller, R. S., "Micromechanical Thin-Film Cavity Structures for Low Pressure and Acoustic Transducer Applications", IEEE 1985, pp. 178-181.

(Continued)

*Primary Examiner*—Suhan Ni
(74) *Attorney, Agent, or Firm*—Muncy, Geissler, Olds & Lowe, PLLC

(57) ABSTRACT

A microphone includes a case, a circuit board, a plate, a cover/button element and an elastic element. The circuit board is disposed in the case and includes a transducer for receiving and converting sound waves into electric signals and a switch operable for turning on and off the circuit board. The plate is disposed in the case and defines two slots and an aperture through which the switch is exposed. A cover/button element includes at least two hooks inserted through the slots defined in the plate so that the cover/button element is movable between a normal position away from the switch of the circuit board and a pushed position in contact with the switch while always covering the case. The elastic element is sandwiched between the plate and the cover/button element for returning the cover/button element to the normal position from the pushed position.

18 Claims, 6 Drawing Sheets

U.S. PATENT DOCUMENTS

| | | | | |
|---|---|---|---|---|
| 5,357,807 | A | 10/1994 | Guckel et al. | 73/721 |
| 5,408,731 | A | 4/1995 | Berggvist et al. | 29/25.41 |
| 5,449,909 | A | 9/1995 | Kaiser et al. | 250/336.1 |
| 5,452,268 | A | 9/1995 | Bernstein | 367/181 |
| 5,490,220 | A | 2/1996 | Loeppert | 381/168 |
| 5,506,919 | A | 4/1996 | Roberts | 385/1 |
| 5,531,787 | A | 7/1996 | Lesinski et al. | 623/10 |
| 5,592,391 | A | 1/1997 | Muyshondt et al. | 364/489 |
| 5,593,926 | A | 1/1997 | Fujihira | 437/209 |
| 5,740,261 | A | 4/1998 | Loeppert et al. | 381/168 |
| 5,748,758 | A | 5/1998 | Menasco, Jr. et al. | 381/176 |
| 5,831,262 | A | 11/1998 | Greywall et al. | 250/227.14 |
| 5,870,482 | A | 2/1999 | Loeppert et al. | 381/174 |
| 5,888,845 | A | 3/1999 | Bashir et al. | 438/53 |
| 5,923,995 | A | 7/1999 | Kao et al. | 438/460 |
| 5,939,968 | A | 8/1999 | Nguyen et al. | 337/12 |
| 6,012,335 | A | 1/2000 | Bashir et al. | 73/724 |
| 6,078,245 | A | 6/2000 | Fritz et al. | 337/297 |
| 6,108,184 | A | 8/2000 | Minervini et al. | 361/111 |
| 6,191,928 | B1 | 2/2001 | Rector et al. | 361/127 |
| 6,282,072 | B1 | 8/2001 | Minervini et al. | 361/103 |
| 6,454,160 | B2 | 9/2002 | Gueissaz | 228/256 |
| 6,522,762 | B1 | 2/2003 | Mullenborn et al. | 381/174 |
| 6,535,460 | B2 | 3/2003 | Loeppert et al. | 367/181 |
| 6,781,231 | B2 | 8/2004 | Minervini | 257/704 |
| 6,952,042 | B2 | 10/2005 | Stratton et al. | 257/418 |
| 2002/0067663 | A1 | 6/2002 | Loeppert et al. | 367/181 |
| 2002/0168080 | A1 | 11/2002 | Pavlovic | 381/369 |
| 2003/0155643 | A1 | 8/2003 | Freidhoff | 257/704 |
| 2003/0183916 | A1 | 10/2003 | Heck et al. | 257/684 |
| 2004/0032705 | A1 | 2/2004 | Ma | 361/223 |

FOREIGN PATENT DOCUMENTS

| | | |
|---|---|---|
| EP | 0774888 | 10/1998 |
| FR | 2555390 | 5/1985 |
| JP | 2002142295 | 5/2002 |
| WO | WO94/25835 | 11/1994 |
| WO | WO02/15636 | 2/2002 |

OTHER PUBLICATIONS

Hohm, D. and Hess, G., "A Submarine Condenser Microphone with Silicon Nitride Membrane and Silicon Back Plate", J. Acoust. Soc. Am. 85 (1), Jan. 1989, pp. 476-480.

Voorthuyzen, J. A., Bergveld, P. and Sprenkels, A. J., "Semiconductor-based Electret for Sound and Pressure", IEEE Transactions on Electrical Insulation, vol. 24, No. 2, Apr. 1989, pp. 267-276.

Murphy, P., Hubschi, K., De Rooij, N. and Racine, C., "Subminiature Silicon Integrated Electret Capacitor Microphone", IEEE Transactions on Electrical Insulation, vol. 24, No. 3 Jun. 1989, pp. 495-498.

Bernstein, J., "A Micromachined Condenser Hydrophone", 1992 IEEE, pp. 161-165.

Torkkeli, A., Rusanen, O. Saarilahti, J., Seppa, H., Sipola, H. and Hietanen, J., "Capactive Microphone with Low-Stress Polysilicon Membrane and High-Stress Polysilicon Backplate", Sensors and Actuators 85 (2000), pp. 116-123.

Wang, W. J., Lin, R. M., Zou, Q. B. and Li, X. X., "Modeling and Characterization of a Silicon Condenser Microphone", J. Micromech. Microeng., vol. 14, 2004, pp. 403-409.

Batra, R. C., Porfiri, M. and Spinello, D., "Electromechanical Model of Electrically Actuated Narrow Microbeams", Journal of Microelectromechanical Systems, vol. 15, No. 5, Oct. 2006, pp. 1175-1189.

Liao, L. L., Wei, W. C., Her, H. C. and Gong, S. C., "Study of Single-Chip Silicon Micromachined Microphones", Proc. of SPIE vol. 6035, pp. A-1-A-8.

3 – 3

4 – 4

5 – 5

MICROPHONE

BACKGROUND OF INVENTION

1. Field of Invention

The present invention relates to a microphone-earphone combination for use with a mobile phone and, more particularly, to a microphone for use in such a combination.

2. Related Prior Art

Mobile phones are popular tools for communication between people in modern societies. Each mobile phone includes a built-in microphone and a built-in earphone. While using a mobile phone, a user holds the mobile phone with one hand, keeping the built-in microphone close to the mouth and the built-in earphone to one ear. However, it is a dangerous practice to hold and use the mobile phone while driving or riding. In fact, in many countries, it is outlawed to hold and use the movable phone while driving or riding.

To solve this problem, microphone-earphone combinations have been devised and used with mobile phones so that people can use their mobile phones without having to hold the same while driving or riding. Such a microphone-earphone combination includes a wire, a plug at an end of the wire, a microphone at a proper point of the wire and an earphone at the other end of the wire. A button is mounted on the microphone. To use the microphone-earphone combination with a mobile phone, a user inserts the plug into a socket made in the mobile phone, and attaches the earphone to an ear, thus locating the microphone close to the mouth. When the mobile phone rings, the user pushes the button to answer the call. Later, the user pushes the button again to hang up.

As mentioned above, the microphone-earphone combination is intended for use while the user is driving or riding. While driving or riding, unless moving his or her sight from the front of the vehicle, the user cannot see the microphone, not to speak of the button. It is however dangerous to move his or her sight from the front of the vehicle to the microphone and, more particularly, the button. To avoid such danger, the user has to feel and search for the button. It often takes a long time for the user to reach the microphone and it takes even longer to reach and push the button. It sometimes takes so long that the call is hung up before it is answered.

Therefore, the present invention is intended to obviate or at least alleviate the problems encountered in prior art.

SUMMARY OF INVENTION

According to the present invention, a microphone includes a case, a circuit board, a plate, a cover/button element and an elastic element. The circuit board is disposed in the case and includes a transducer for receiving and converting sound waves into electric signals and a switch operable for turning on and off the circuit board. The plate is disposed in the case and defines two slots and an aperture through which the switch is exposed. A cover/button element includes at least two hooks inserted through the slots defined in the plate so that the cover/button element is movable between a normal position away from the switch of the circuit board and a pushed position in contact with the switch while always covering the case. The elastic element is sandwiched between the plate and the cover/button element for returning the cover/button element to the normal position from the pushed position.

The primary advantage of the microphone according to the present invention is convenient maneuvering because the switch is easily pushed by pushing any point of the cover/button element.

Other advantages and features of the present invention will become apparent from the following description referring to the drawings.

BRIEF DESCRIPTION OF DRAWINGS

The present invention will be described through detailed illustration of the preferred embodiment referring to the drawings.

DETAILED DESCRIPTION OF PREFERRED EMBODIMENT

Figure 1:
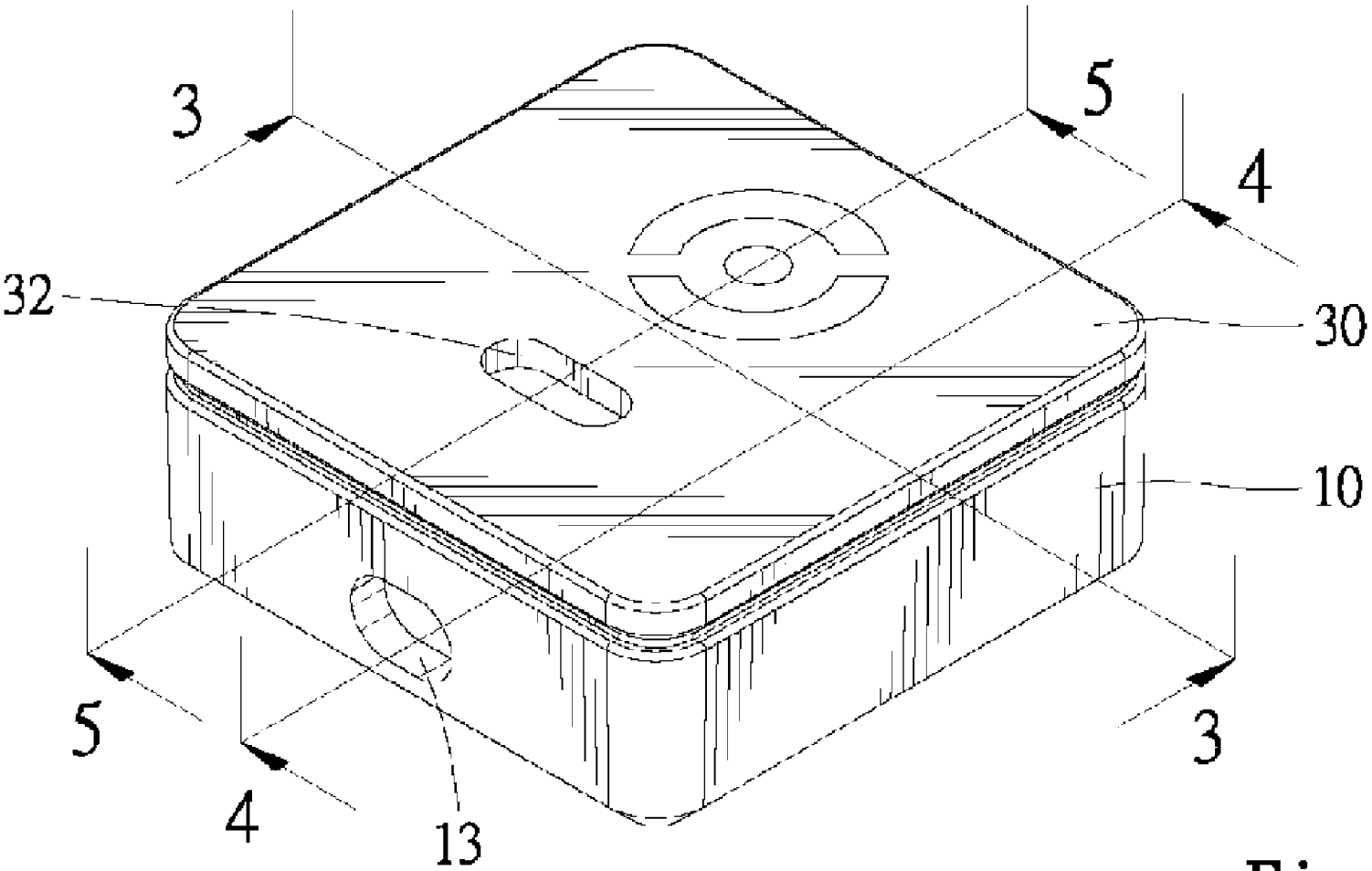
FIG. 1 is a perspective view of a microphone according to the preferred embodiment of the present invention.
Figure 2:
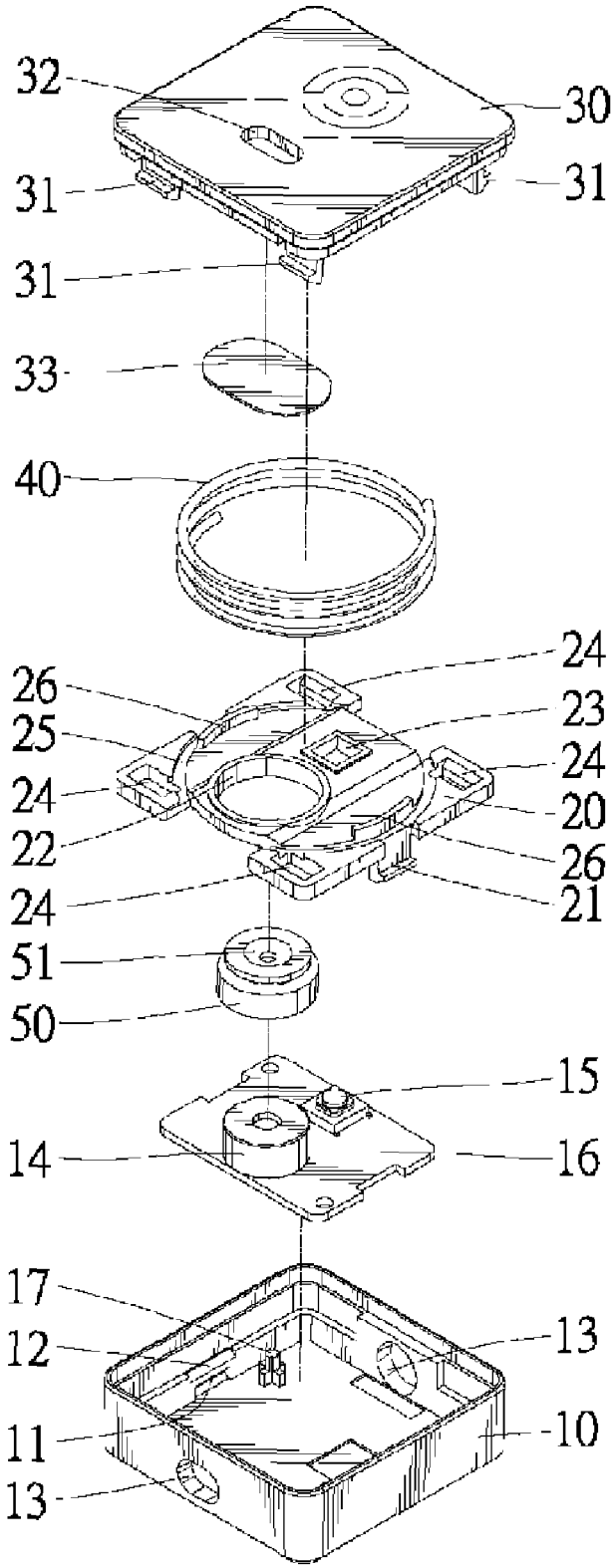
FIG. 2 is an exploded view of the microphone shown in FIG. 1.

Referring to FIGS. 1 through 5, there is shown a microphone according to the preferred embodiment of the present invention. The microphone includes a case 10, a circuit board 16, an elastic cap 50, a plate 20, an elastic element 40, a film 33 and a cover/button element 30.

The case 10 includes a square floor and four walls. Each of the walls includes a lower portion and an upper portion thinner than the lower portion. A recess 11 is defined in the lower portion of one of the walls, and a slope 12 is formed between the lower and upper portions of the one of the walls. Similarly, a recess 11 is defined in and a slope 12 is formed on an opposite one of the walls. An aperture 13 is defined in each of the other walls. Two stems 17 are extended from the floor.

The circuit board 16 includes a transducer 14 and a switch 15 both mounted thereon. The transducer 14 is used for receiving and converting sound waves into electric signals. The switch 15 is operable for turning on and off the circuit board 16. Two apertures are defined in the circuit board 16.

The elastic cap 50 includes a tubular portion at a lower end and a funnel-shaped portion 51 at an upper end. The funnel-shaped portion 51 defines an aperture. At least the funnel-shaped portion 51 is elastic.

The plate 20 includes two hooks 21 extended from the bottom thereof and two walls 26 extended from the top thereof. The plate 20 defines a groove 25 within the top thereof, an opening 22, an aperture 23 and four slots 24.

The elastic element 40 is preferably a helical spring.

The film 33 is used to protect the microphone from dirt.

The cover/button element 30 is shaped corresponding to the case 10. The cover/button element 30 includes four hooks 31 extended from the bottom thereof and a pusher 34 (FIG. 3) extended from the bottom thereof. The cover/button element 30 defines a groove 35 (FIG. 3) within the top thereof and a sound aperture 32.

Figure 3:
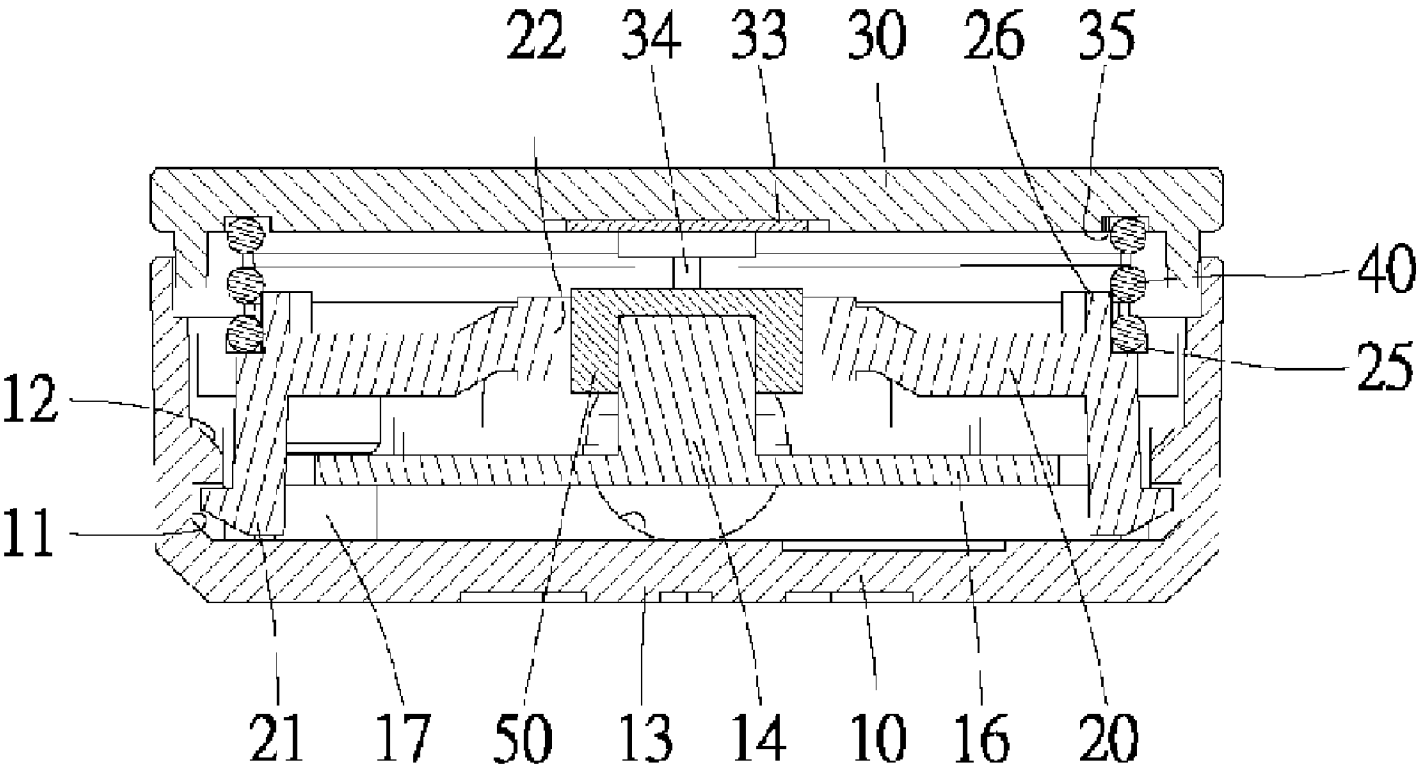
FIG. 3 is a cross-sectional view of the microphone taken along a line 3-3 in FIG. 1.
Figure 4:
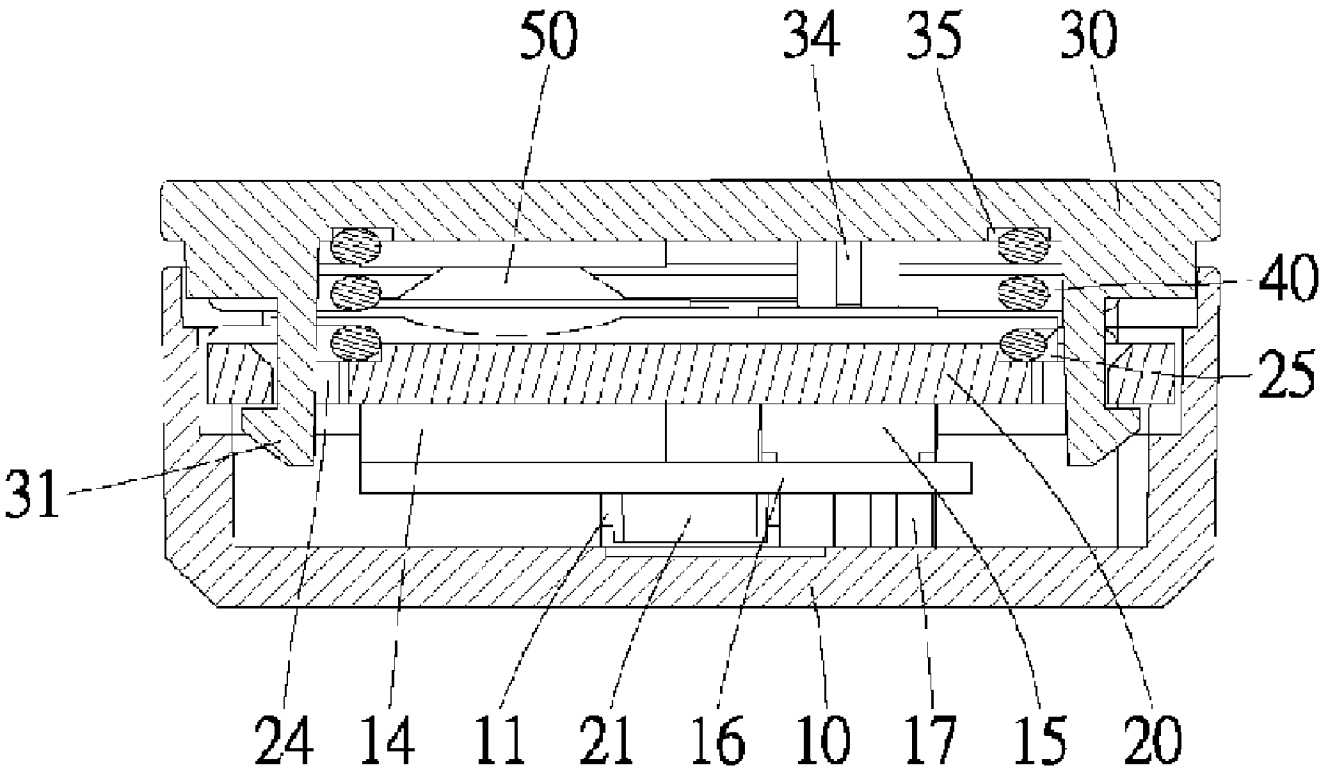
FIG. 4 is a cross-sectional view of the microphone taken along a line 4-4 in FIG. 1.
Figure 5:
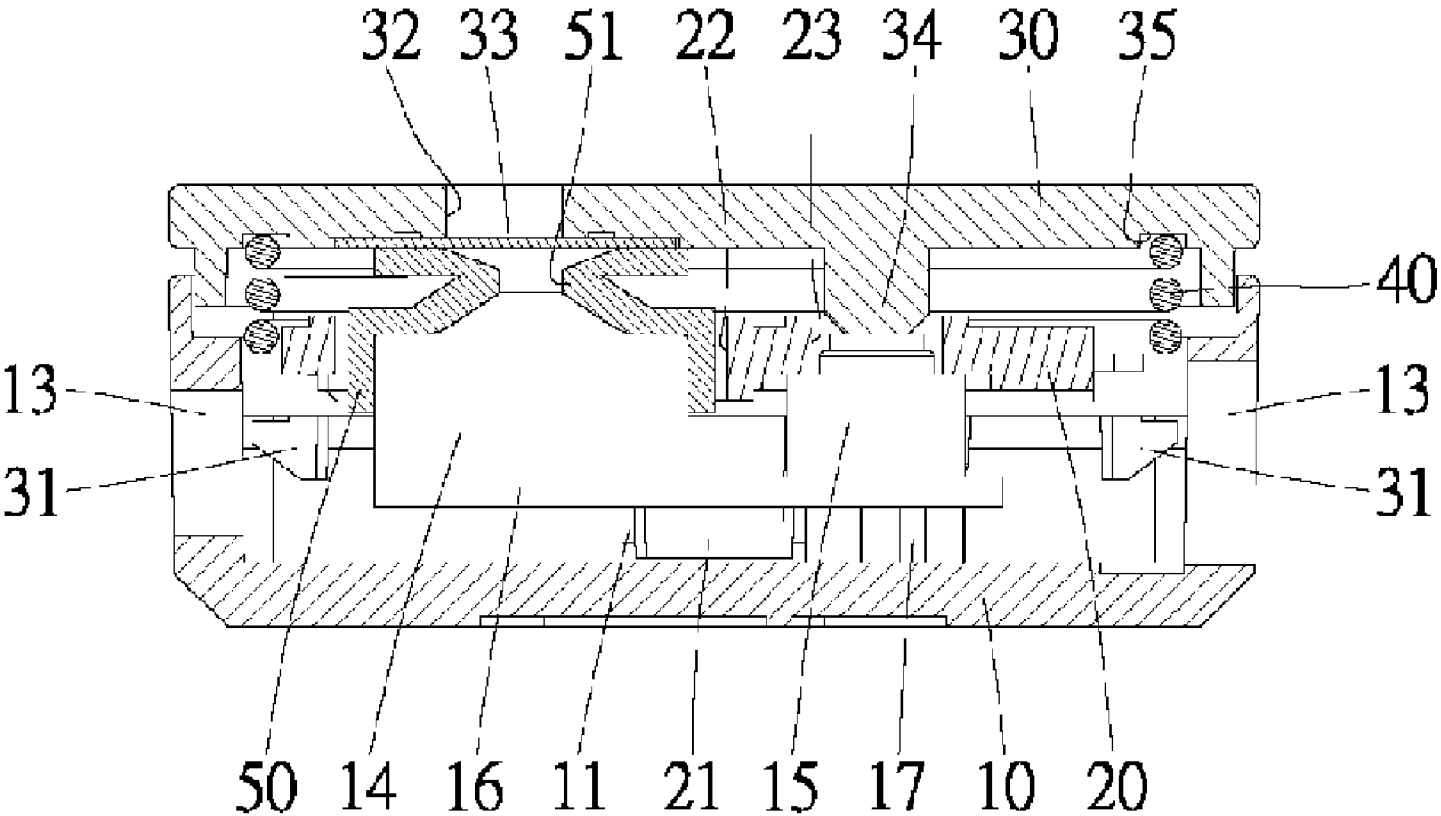
FIG. 5 is a cross-sectional view of the microphone taken along a line 5-5 in FIG. 1.

Referring to FIGS. 3 through 5, the circuit board 16 is disposed in the case 10. The stems 17 of the case 10 are fit in the apertures defined in the circuit board 16 so that the circuit board 16 is firmly disposed in the case 10.

The elastic cap 50 is mounted on the transducer 14 so that the funnel-shaped portion 51 facilitates the transfer of the sound waves to the transducer 14 clearly and loudly.

The plate 20 is disposed in the case 10. The hooks 21 are moved past the circuit board 16. Then, the hooks 21 are guided and moved on the slopes 12 so that they can be inserted into the recesses 11 smoothly. With the hooks 21 trapped in the recesses 11, the plate 20 is securely disposed in the case 10. The elastic cap 50 is inserted through the opening 22. The switch 15 is inserted in the aperture 23.

The elastic element 40 is mounted on the plate 20. A lower end of the elastic element 40 is disposed in the groove 25 defined in the plate 20. Furthermore, the lower end of the elastic element 40 is positioned by the walls 26 of the plate 20.

The film 33 is placed on the funnel-shaped portion 51.

The cover/button element 30 is placed on the case 10. The hooks 31 are inserted through the slots 24 so that the cover/button element 30 is movably connected to the plate 20. The pusher 34 is in contact with the switch 15. The sound aperture 32 is shielded by the film 33. An upper end of the elastic element 40 is disposed in the groove 35. The elastic element 40 is sandwiched between the cover/button element 30 and the plate 20. The elastic cap 50 is sandwiched between the cover/button element 30 and the circuit board 16.

Figure 6:
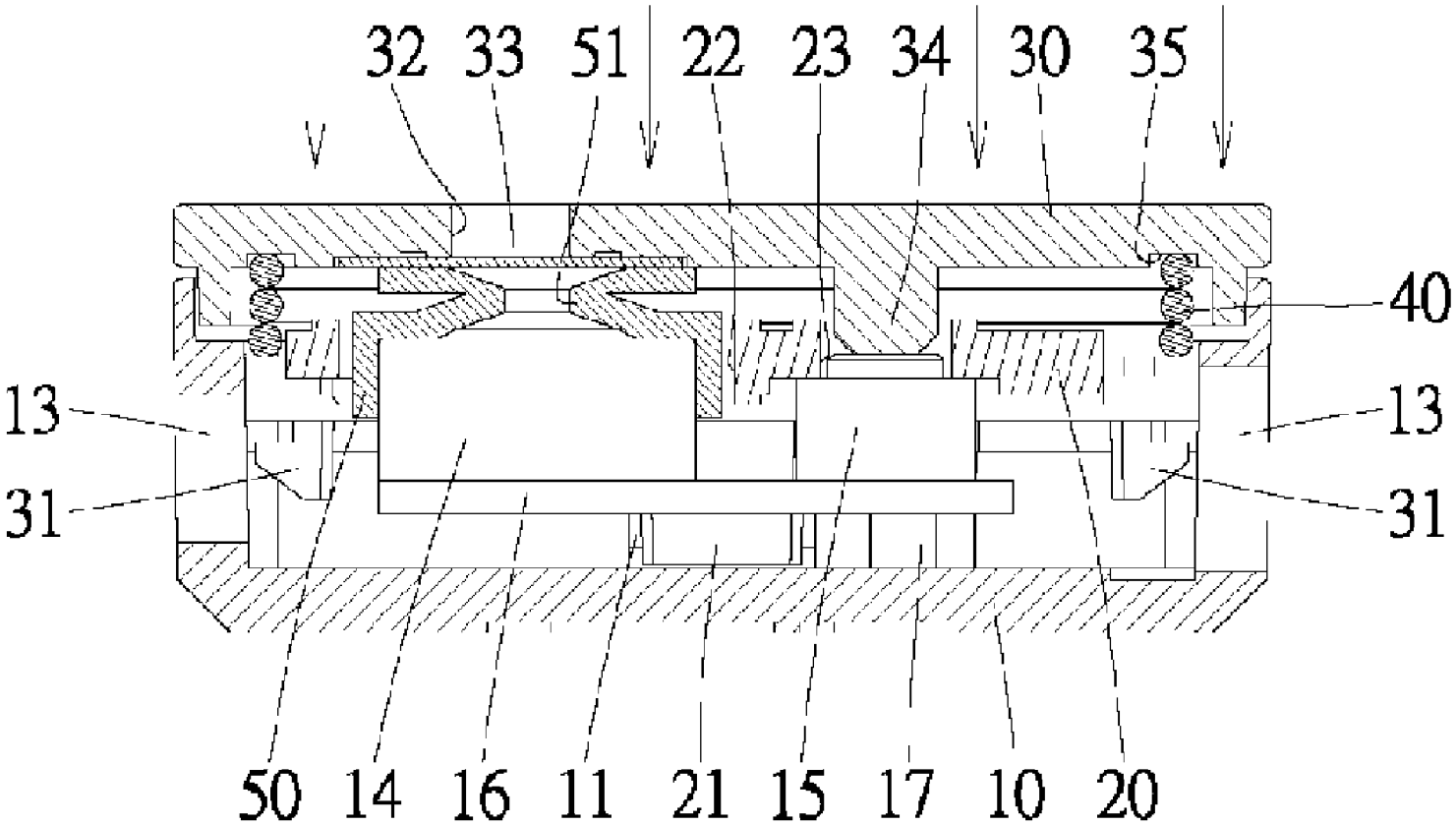
FIG. 6 is a cross-sectional view of the microphone in a pushed position instead of a normal position shown in FIG. 5.

Referring to FIG. 6, the cover/button element 30 is pushed by a user. In turn, the switch 15 is pushed by the pusher 34 so that a call can be answered or hung up. The elastic element 40 and the elastic cap 50 are compressed.

When released from the user, the cover/button element 30 is smoothly returned to the normal position shown in FIG. 5 by the elastic element 40 and the elastic cap 50.

The microphone according to the present invention exhibits several advantages. Firstly, it can conveniently be maneuvered because the switch 15 is easily pushed by pushing any point of the cover/button element 30. Therefore, there is no need to go through a lot of trouble in feeling and searching for a tiny button in a microphone.

Secondly, its operation is smooth for using both of the elastic element 40 and the elastic cap 50 to return the cover/button element 30.

Thirdly, it receives the sound waves clearly and loudly due to the funnel-shaped portion 51 of the elastic cap 50 for directing the sound waves to the transducer 14.

The present invention has been described via the detailed illustration of the preferred embodiment. Those skilled in the art can derive variations from the preferred embodiment without departing from the scope of the present invention. Therefore, the preferred embodiment shall not limit the scope of the present invention defined in the claims.

What is claimed is:

1. A microphone comprising:

a case;

a circuit board being disposed in the case and comprising a transducer for receiving and converting sound waves into electric signals and a switch operable for turning on and off the circuit board;

a plate being disposed in the case and defining two slots and an aperture through which the switch is exposed;

a cover/button element comprising at least two hooks inserted through the slots defined in the plate so that the cover/button element is movable between a normal position away from the switch of the circuit board and a pushed position in contact with the switch while always covering the case; and an elastic element sandwiched between the plate and the cover/button element for returning the cover/button element to the normal position from the pushed position.

2. The microphone according to claim 1 wherein the plate defines four slots, and the cover/button element comprises four hooks inserted through the slots defined in the plate.

3. The microphone according to claim 1 wherein the plate defines an opening through which the transducer is exposed.

4. The microphone according to claim 3 comprising an elastic cap for covering the transducer and returning the cover/button element to the normal position from the pushed position.

5. The microphone according to claim 4 wherein the elastic cap comprises a funnel-shaped portion formed thereon for facilitating the transfer of the sound waves to the transducer.

6. The microphone according to claim 1 wherein the plate comprises two hooks extended from a face thereof, and the case defines two recesses for receiving the hooks of the plate.

7. The microphone according to claim 6 wherein the case comprises a lower portion in which the recesses are defined an upper portion thicker than the lower portion and defines two slopes between the lower and upper portion for guiding the hooks of the plate into the recesses defined in the case.

8. The microphone according to claim 3 wherein the cover defines a sound aperture aligned with the opening defined in the plate.

9. The microphone according to claim 8 comprising a film for shielding the sound aperture so that dirt is filtered out while the sound waves are admitted into the case.

10. The microphone according to claim 1 wherein the cover/button element comprises a pusher inserted through the aperture defined in the plate for contact with the switch of the circuit board.

11. The microphone according to claim 1 wherein the elastic element is a helical spring.

12. The microphone according to claim 11 wherein the cover/button element defines a groove for receiving an end of the elastic element.

13. The microphone according to claim 11 wherein the plate defines a groove for receiving an end of the elastic element.

14. The microphone according to claim 11 wherein the plate comprises two walls for positioning the elastic element.

15. The microphone according to claim 1 wherein the cover/button element is shaped corresponding to the case.

16. The microphone according to claim 1 wherein the case defines two apertures through which a wire is inserted.

17. The microphone according to claim 1 wherein the case comprises at least one stem fit in an aperture defined in the circuit board.

18. The microphone according to claim 17 wherein the case comprises two stems fit in two apertures defined in the circuit board.

* * * * *